United States Patent [19]

Holmes, Jr.

[11] Patent Number: 4,502,798

[45] Date of Patent: Mar. 5, 1985

[54] TYPEWRITER BASEPLATE ATTACHMENT ENABLING USE OF PRINT KEYS FOR NON-PRINT OPERATIONS

[76] Inventor: Lawrence Holmes, Jr., 4 Cambridge Rd., Pompton Lakes, N.J. 07442

[21] Appl. No.: 577,319

[22] Filed: Feb. 7, 1984

Related U.S. Application Data

[63] Continuation of Ser. No. 457,972, Jan. 14, 1983, abandoned, which is a continuation of Ser. No. 139,335, Apr. 11, 1980, abandoned.

[51] Int. Cl.[3] ..... B41J 5/30

[52] U.S. Cl. ..... 400/66; 400/300; 400/479; 400/697.1; 200/1 A

[58] Field of Search ..... 400/8, 15, 62, 63, 66, 400/69, 72, 73, 166, 300, 301, 302, 368, 369, 479, 696, 697.1; 178/4.1 R; 200/1 A, 1 TK, 5 D, 6 BB, 6 C, 159 A

[56] References Cited

U.S. PATENT DOCUMENTS

| | | | |
|---|---|---|---|
| 1,157,028 | 10/1915 | Noble | 200/1 A X |
| 1,749,936 | 3/1930 | Coffey | 200/1 A X |
| 1,787,176 | 12/1930 | Spitzglass | 200/1 A X |
| 2,498,569 | 2/1950 | Mork | 200/1 A X |
| 3,165,190 | 1/1965 | Wenczel | 400/479 X |
| 3,197,618 | 7/1965 | Stanley et al. | 400/62 X |
| 3,233,715 | 2/1966 | Flieg | 400/62 |
| 3,239,049 | 3/1966 | Voit, Jr. | 400/166 |
| 3,380,569 | 4/1968 | Becking et al. | 400/62 |
| 3,382,963 | 5/1968 | Cralle, Jr. et al. | 400/8 |
| 3,391,774 | 7/1968 | Greer | 400/366 X |
| 3,404,766 | 10/1968 | Castle et al. | 400/8 X |
| 3,414,103 | 12/1968 | Knudsen et al. | 400/72 |
| 3,452,851 | 7/1969 | Holmes, Jr. | 400/66 |
| 3,453,379 | 7/1969 | Holmes, Jr. | 400/62 X |
| 3,618,736 | 11/1971 | Abell, Jr. et al. | 400/166 |
| 3,643,773 | 2/1972 | Holmes, Jr. | 400/66 |
| 3,646,573 | 2/1972 | Holmes, Jr. | 178/4.1 R |
| 3,658,161 | 4/1972 | Holmes, Jr. | 400/66 |
| 3,799,316 | 3/1974 | Davidge et al. | 400/697.1 |
| 4,130,744 | 12/1978 | Beecher et al. | 200/1 A |

OTHER PUBLICATIONS

IBM Technical Disclosure Bulletin, "Manual Override for Print Impact Control", Risedorf, Jr., vol. 11, No. 12, May 1969, p. 1753.

IBM Technical Disclosure Bulletin, "Print Velocity Control Device", Abell et al, vol. 12, No. 7, Dec. 1969, p. 1032.

*Primary Examiner*—Ernest T. Wright, Jr.

*Attorney, Agent, or Firm*—Phillips, Moore, Lempio & Finley

[57] ABSTRACT

A typewriter baseplate attachment for generating electrical signals that identify operations performed by the typewriter wherein, through the actuation of solenoids located in the baseplate attachment, the keys of the typewriter can be depressed to initiate the functional operations without the characters associated with the keys printing on the paper in the typewriter. This non-printing is effected through solenoid actuation of the correcting mechanism of the typewriter and suppression of the backspacing movement that normally accompanies operation of the correction mechanism.

9 Claims, 7 Drawing Figures

TYPEWRITER BASEPLATE ATTACHMENT ENABLING USE OF PRINT KEYS FOR NON-PRINT OPERATIONS

This is a continuation of Ser. No. 457,972 filed Jan. 14, 1983, now abandoned, which is a continuation of Ser. No. 139,335 filed Apr. 11, 1980, now abandoned.

DESCRIPTION

1. Technical Field

The present invention relates to electric typewriters, and in particular to baseplates attachable thereto to enable the typewriter to perform certain print and function operations. Some of these print and function operations can be used for purposes of text editing.

2. Background Art

In recent years the technology associated with automatic typewriters which can perform memory and text editing functions has grown quite rapidly. There are at present a wide variety of such typewriters in all price brackets for performing such simple functions as remembering and automatically typing addresses, to more complex functions including sophisticated text editing where a multiple page text can be retained in a memory and specific areas of such text or specific words can be recalled and amended. In addition, these and similar typewriters can be used as data terminals for transmitting and receiving information over telephone lines and the like.

The above discussed prior art typewriters have heretofore been highly specialized, expensive and intricate in construction, and have generally required a specially-trained operator. It is advantageous to adapt a standard electric office typewriter for service as a data terminal with a minimum of expense and difficulty, without interfering with the original operation of the typewriter. Mechanisms and circuits for this purpose are disclosed in my prior U.S. Pat. No. 3,453,379, issued on July 1, 1969; U.S. Pat. No. 3,646,573, issued on Feb. 29, 1973; U.S. Pat. No. 3,452,851, issued on July 1, 1969; U.S. Pat. No. 3,643,773, issued on Feb. 22, 1972; and U.S. Pat. No. 3,658,161, issued on Apr. 25, 1972. These patents contemplate the use of a baseplate which can be quickly and conveniently secured to a standard electric typewriter without requiring the direct interconnection of moving elements of the baseplate with those of the typewriter. This enables the typewriter to be linked through the baseplate to a memory and logic unit which can be affixed to the baseplate or located separately therefrom, or enables the typewriter to be connected to telephone lines for data transmission.

The baseplates of the above-identified patents include sensing switches which generate signals identifying print and function operations performed by the typewriter and also have solenoids having movable armatures which are employed to perform manipulations of the internal mechanisms of the electric typewriter to initiate typewriter operations responsive to incoming electrical signals to the solenoids.

It is to be understood that a standard electric office typewriter equipped with the baseplate attachment of my prior patents does not have extra keys for generating the control signals that are needed to initiate standard text editing functions, such as locating and deleting words, making corrections, and reorganizing the various paragraphs of the text. Thus some means must be provided for the purpose in in order to use a baseplate of that type as the link between a standard electric typewriter and text editing circuitry. Preferably this should not require the addition of a series of extra keys for control signal generation.

It has heretofore been recognized in the art that the print keys of a standard typewriter keyboard can be used to generate non-print control signals by modifying the signal that is normally generated by operation of the print key. However, when the key is temporarily being used for such a purpose, it is highly desirable that the character of the key not be printed on the page of the text in the typewriter and also that the space operation that normally follows printing of a character be prevented. Heretofore this has required substantial modifications of the internal mechanism of the typewriter. For example, one prior system of this kind requires installation of a non-print clutch within the typewriter, wherein the key, when depressed in appropriate circumstances so as to initiate a functional text editing signal, does not cause printing of a character on the page. Thus, still further improvements are needed to provide for efficient and economical non-print control signal generation at a standard electric office typewriter which has been modified through the placement of an improved baseplate thereon to couple the typewriter to text editing circuitry or the like.

The present invention is directed to overcoming the problem as set forth above.

DISCLOSURE OF THE INVENTION

In one aspect of the invention a typewriter attachment has reader means for generating electrical signals that identify characters printed by a typewriter which typewriter is of the form that has a plurality of print keys for initiating printing of characters on a paper, escapement means for initiating a spacing operation following printing of a character, backspacing means for initiating backspacing operations, correction means for removing a previously printed character from the paper, and a manually operable correction initiating key which actuates both said backspacing means and said correction means, and wherein operation of said correction means temporarily inactivates said escapement means. The typewriter attachment further includes a manually operable control signal initiating switch, means for transmitting a control signal identifying voltage in response to operation of the control signal initiating switch, and actuator means for actuating the correction means of the typewriter independently of the correction initiating key of the typewriter and independently of the backspacing means of the typewriter in response to concurrent operation of the control signal initiating switch of the attachment and a print key of the typewriter. Consequently, the print keys of the typewriter may be selectively used to initiate non-print control signal generation by the reader means without printing of the characters represented by the print keys on the paper and without spacing operation of the typewriter in either direction.

In another aspect, the invention provides an electrical switch having first, second and third contacts which are normally spaced apart when the switch is is in an unoperated condition, at least the first and second contacts being flexible resilient leaf springs, and having a manually depressible button which is movable to deflect the first contact towards the second contact to establish electrical connection therebetween and which is further movable to deflect both the first contact and the second contact toward the third contact to establish electrical connection between all three of the contacts. The second contact is resiliently biased to deflect toward the first contact and stop means are provided for limiting deflection of the second contact towards the first contact in response to the resilient biasing of the second contact.

Accordingly, the present invention solves the problems of the prior art devices in that there is no need for additional function keys to be added to the standard typewriter keyboard. Also, there is no need for internal alterations in the standard typewriter mechanism, such as installation of a clutch mechanism in order to have a selected key have both a function operation and a print operation, with the key not printing a character during the function operation.

Additional objects, advantages and novel features of the invention will be set forth in part in the description which follows, in part will become apparent to those skilled in the art upon examination of the following, or may be learned by practice of the invention. The objects and advantages of the invention may be realized and attain by means of the instrumentalities and combinations particularly pointed out in the appended claims.

BRIEF DESCRIPTION OF THE DRAWING

The accompanying drawing, which is incorporated in and forms a part of the specification, illustrates one embodiment of the present invention and, together with the description, serves to explain the principles of the invention. In the drawing.

BEST MODE OF CARRYING OUT THE INVENTION

Before describing the present embodiment of the invention in great detail, relevant portions of a standard self-correcting typewriter 10 and of the embodiment of the invention as they appear in FIG. 1 and portions of the typewriter as they appear in FIG. 2 will be discussed.

Figure 1:
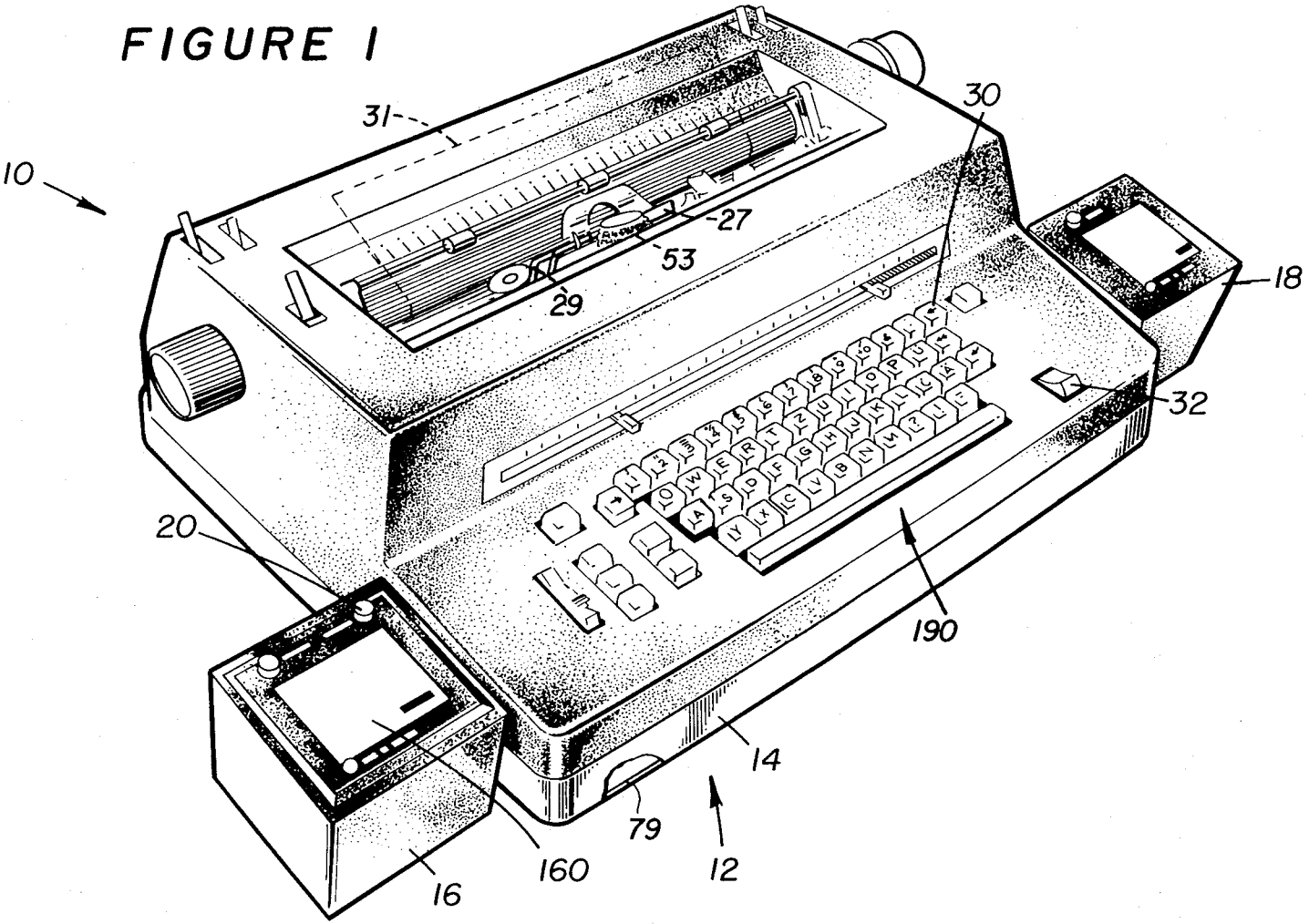
FIG. 1 is a perspective view of a spacer band of an embodiment of the baseplate attachment of the invention secured to a standard electric typewriter.

With reference to FIG. 1, a standard electric typewriter is identified by the numeral 10. Typewriter 10, as depicted, is an electric, self-correcting, Remington Rand® typewriter Model SR 101. It is to be understood, however, that the invention can be practiced on other self-correcting typewriters, as, for example, produced by International Business Machine Corporation.

The baseplate attachment 12 of the invention includes a spacer band 14 (FIGS. 1, 3, 4) which increases the elevation of the typewriter keys approximately an additional one inch from a table, to accommodate the various components of the baseplate attachment 12 which will be described hereinbelow. Secured on either side of the spacer band 14 are text editing components housings 16 and 18, herein termed the recall/logic pod and save/-logic pod respectively. The text editing components within housings 16 and 18 may be of known forms which receive and temporarily store signals indicative of print and function operations performed by a typewriter 10 and subsequently feed back such signals to the typewriter for re-execution of such operations by the typewriter and which perform the various editing functions, such as making insertions and deletions in the signal sequence, in response to control signals. The text editing components within housings 16 and 18 are not themselves a part of the present invention and therefore will not be further described.

It is to be understood that the baseplate attachment 12 (FIG. 1) can be conveniently secured to the electric typewriter 10 as described in more detail in U.S. Pat. No. 3,452,851 by removing the standard bottom plate 79 (FIG. 3) of the typewriter 10 and then securing attachment 12 between the bottom plate 79 and the rest of the typewriter 10. No other electrical or mechanical connections need be made between the baseplate attachment 12 and the typewriter 10, although such connections are possible and often done. The above-referenced patents particularly U.S. Pat. No. 3,452,851, describe a suitable detailed construction for a baseplate attachment 12 of this kind that can be affixed to a standard electric typewriter 10 to produce multi-bit signals that identify characters printed at the typewriter 10 and to actuate the typewriter 10 to reprint such characters in response to feedback of such signals. The attachment 12 of the present invention may be similar to that of U.S. Pat. No. 3,452,851 except for a small number of added components to be hereinafter described that enable the print keys 190 of the typewriter 10 to be used for non-print operations, such as generation of control signals, without printing of the character of the key on the paper 31 (FIG. 1) and without escape or spacing movement that normally follows operation of a print key 190. This is accomplished without requiring any internal structural modification of moving elements of the typewriter 10 itself.

Figure 2:
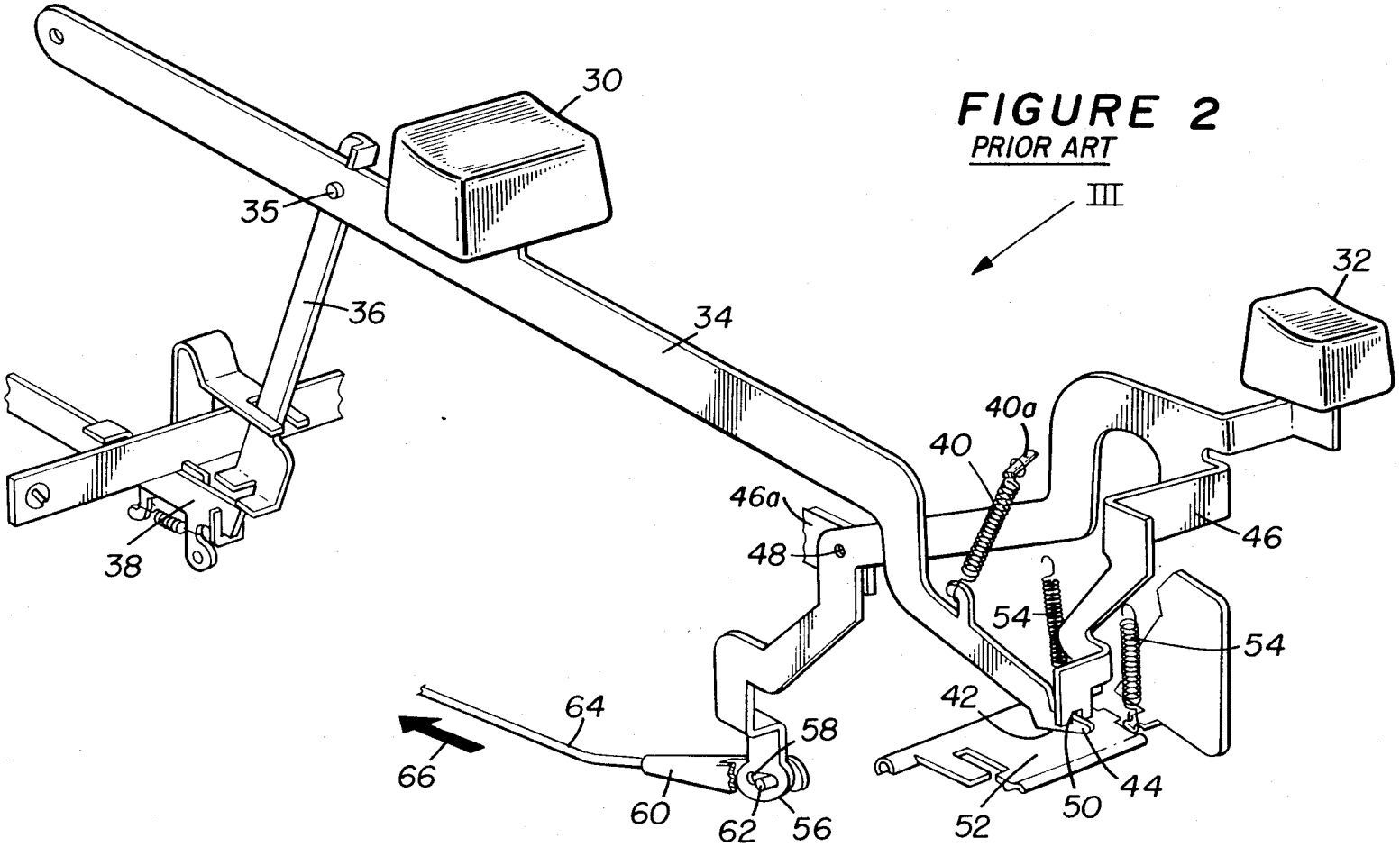
FIGURE 2 PRIOR ART
FIG. 2 is a perspective view of a backspace key and a correcting backspace key and associated linkage of the typewriter of FIG. 1.
Figure 3:
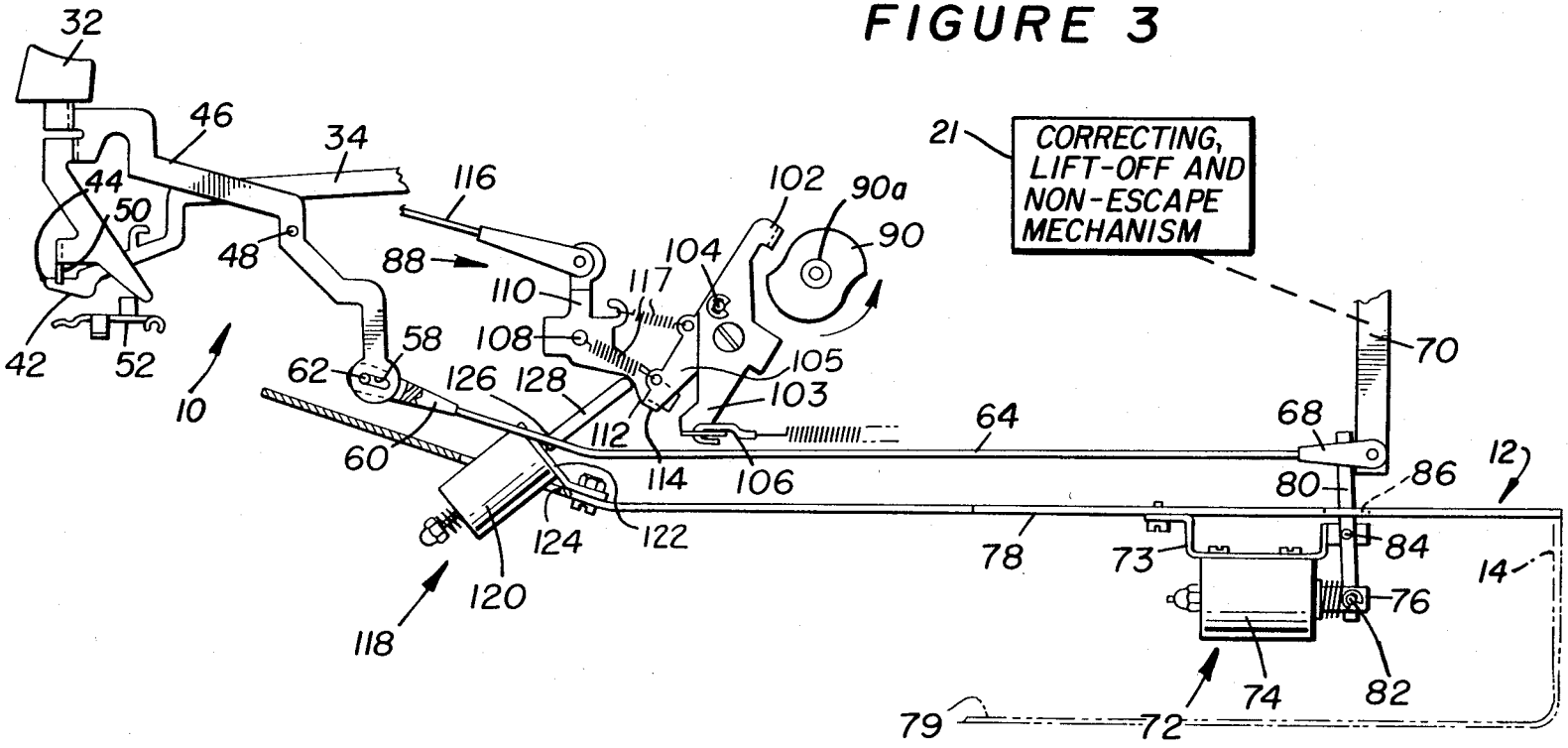
FIG. 3 is a side elevational view showing the correcting backspace key and associated linkage, taken in the direction of arrow III in FIG. 2 and further depicting an embodiment of the baseplate attachment of the invention.

With reference to FIG. 3, typewriters 10 of the hereinbefore identified known type include correction means 21, termed the correcting, lift-off and non-escape mechanism in service manuals, that may be actuated by manual depression of a correction initiating key 32 which is termed the correcting backspace key in service manuals but which is distinct from the primary backspace key 30 (FIG. 2) of the typewriter 10.

FIG. 2 depicts the backspace key 30 and the correcting backspace key 32 of typewriter 10 with associated linkage. Depression and release of the backspace key 30 (FIG. 2) causes the typewriter 10 (FIG. 1) to backspace one space, while the depression and release of the correcting backspace key 32 (FIG. 2) causes the typewriter 10 (FIG. 1) to backspace one space and trips the correcting lift-off and non-escape mechanism 21 (FIG. 3) of the self-correcting typewriter 10 (FIG. 1) so that an incorrectly printed character can be removed preparatory to the printing of a correct character in the space previously occupied by the incorrect character. On self-correcting typewriters 10 of this type, the incorrectly printed character is actually lifted off the paper 31 by a correcting ribbon or tape 29 which is impressed against the paper 31 to withdraw the ink which has impregnated the paper 31. The correcting ribbon or tape 29 is impressed using the same key which was previously incorrectly struck. The correcting ribbon 29 (FIG. 1) is in general located adjacent the carbon ribbon 27 and, as is well-known, is drawn into position between the carbon ribbon 27 and the paper 31, after the correcting backspace key 32 (FIGS. 1, 2) is depressed and preparatory to the print element 53 (FIG. 1) striking the paper 31 to impress the correcting ribbon 29 against the paper 31. As a new character or space is to be placed where the incorrectly printed character was removed, the correcting backspace key 32 (FIG. 2) as indicated above additionally inhibits escape of the typewriter 10 (FIG. 1) so that after the incorrect key is depressed to remove the incorrectly typed character, the typewriter 10 does not space over one space. Accordingly, a correct character can be inserted in the position of the incorrectly typed character. This operation returns the typewriter 10 (FIG. 1) to normal status and a space or escape occurs after the correct character is struck. The correcting, lift-off and non-escape mechanism 21 (FIG. 3) discussed above is a pre-existing, known internal component of commercial typewriters 10 (FIG. 1) of the hereinbefore described kind and is depicted and described in detail in the service manuals published and distributed by the manufacturers of such typewriters.

It is to be understood that besides the lift-off correcting ribbon 29 other types of ribbons, such as ribbons which have a white covering substance, can be used to accomplish the above correcting.

Briefly reviewing the various linkages and mechanisms depicted in FIG. 2, which are pre-existing known typewriter components, backspace key 30 is positioned on backspace key bar 34. Pivotally mounted on backspace key bar 34 at pivot point 35 is backspace linkage 36. Backspace linkage 36 is located adjacent to backspace interposer 38, which actuates the typewriter 10 to backspace. Backspace key bar 34 is biased upwardly by tension spring 40, which is secured thereto at one end and at an opposite end to another portion 40*a* of typewriter 10. Backspace key bar 34 at an end located distally from backspace key 30 defines a heel 42 and a tip 44. Correcting backspace key 32 is secured to a bracket 46 which is pivotally mounted on a portion 46*a* of typewriter 10 at pivot point 48. Bracket 46 includes a bifurcated end 50, which rests on either side of tip 44 of backspace key bar 34.

Positioned below heel 42 is a plate 52, which is biased upwardly by tension springs 54. Depressing correcting backspace key 32 until heel 42 contacts plate 52 (FIGS. 2, 3) causes the typewriter 10 to backspace one space and, as will be described hereinbelow, triggers the lift-off and non-escape mechanism 21. Depressing correcting backspace key 32 even further, so as to "break through" a tension level created by tension springs 54 and pivot plate 52, causes the typewriter 10 to backspace repeatedly as long as correcting backspace key 32 is depressed.

Another end 56 of bracket 46 defines a slot 58, and is surrounded by clevis 60 (shown partially broken away). A pin 62 of said clevis 60 is received in and can slide in slot 58. Pin 62 and slot 58 define a lost motion mechanism. Secured to clevis 60 is rod 64, which comprises part of the standard lift-off and non-escape mechanism 21, which is well known in the art and which is tripped as rod 64 is moved in the direction of arrow 66. Accordingly, the depression of correcting backspace key 32 causes the typewriter 10 (FIGS. 1, 3) to backspace and trips the lift-off and non-escape mechanism 21 to cause the connecting ribbon 29 to be positioned between the carbon ribbon 27 and the paper before the print element 53 strikes towards the paper 31 to remove the incorrect character printed thereon.

In FIG. 3, a right-elevational view of correcting backspace key 32, backspace key bar 34, and plate 52 are shown as such elements would appear if viewed in direction of arrow II depicted in FIG. 2. As can be seen in FIG. 3, rod 64 extends and ends in a second clevis 68, which is pivotally secured to the trigger 70 of the lift-off and non-escape mechanism 21 of the typewriter 10.

Figure 4:
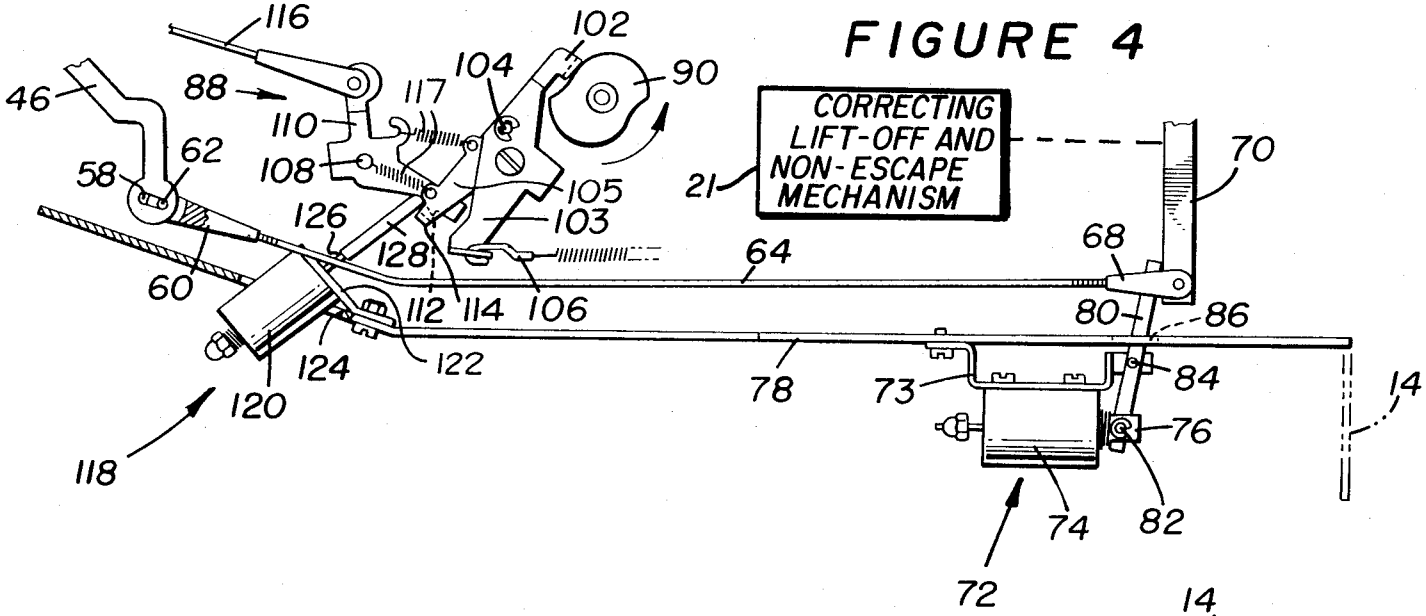
FIG. 4 is a view similar to FIG. 3, with the correcting backspace key removed and with the linkage of the typewriter moved to an actuated position by the embodiment of the baseplate attachment of the invention.

With the trigger 70 in the first position as shown in FIG. 3, the lift-off and non-escape mechanism 21 is not activated or triggered. With the trigger 70 positioned in a second position as shown in FIG. 4, the lift-off and non-escape mechanism 21 is triggered as is necessary for correcting a mistyped character.

The first means of the invention for actuating the pre-existing correction means or lift-off and non-escape mechanism 21 of the typewriter 10 (FIG. 1) for allowing a print 21 key 190 of the typewriter 10 to be struck without the typewriter 10 spacing and without leaving a visible character imprint is denoted by the numeral 72 and includes a lift-off and non-escape solenoid 74, which is actuated by an electrical signal, and a solenoid plunger or armature 76. Means 72 is secured to a mounting plate 78 (FIGS. 4, 5) which is part of the baseplate attachment 12, by mounting bracket 73. Baseplate attachment 12, as previously indicated, includes spacer band 14 which is attached to typewriter bottom pan 79 which rests on the top of a desk upon which the typewriter 10 is placed.

An actuator arm 80 (FIGS. 3, 4) is pivotally secured at point 82 to plunger or armature 76 and also at pivot point 84 to mounting bracket 73. Further, actuator arm 80 projects upwardly through an aperture 86 in mounting plate 78, to a first position (FIG. 3) adjacent lift-off and non-escape trigger 70. Actuation of the solenoid 74 causes actuator arm 80 to move to a second position as shown in FIG. 4 urging the lift-off and non-escape trigger 70 into the second position thereof, which is necessary for the typewriter 10 to be able to perform the correcting function. It is important to note that, as actuator arm 80 moves from the first position of FIG. 3 to the second position of FIG. 4, the pin 62, which is located in slot 58 defined at the end of bracket 46, moves from one end of said slot 58 to the other end of said slot 58 without moving bracket 46 or in any way causing it to pivot. Thus, no backspace function is initiated as bracket 46 and correcting backspace key 32 do not move due to the lost motion mechanism defined by pin 62 and slot 58.

Typewriters 10 of the hereinbefore identified type include a velocity control mechanism 88 portions of which are shown in FIG. 3 positioned adjacent to correcting backspace key 32 which mechanism 88 is well known in the art and are described in detail in the service manuals for the hereinbefore identified commercial typewriter models. Velocity control mechanism 88 has a high-velocity print mode and a low-velocity print mode. The high-velocity print mode is used when large area characters are being printed on the paper 31, while the low-velocity mode is used when small-area characters such as periods, commas, and hyphens, are printed on the paper 31. In the low-velocity print mode, the print element 53 (FIG. 1) which imprints a character on the paper 31 is withheld slightly so that the element does not strike the paper 31 with such great force and thus does not perforate the paper 31. As shown in FIG. 3, the velocity control mechanism 88 of a known typewriter 10 (FIG. 1) of this kind includes a cam 90 (FIG. 3) which is mounted on a filter shaft 90*a* of typewriter 10. Cam 90 rotates through 180° for each character which is to be printed on the paper 31. Velocity control mechanism 88 further includes a cam follower 102 which can be selectively placed in contact with cam 90, and cam follower 102 is pivoted about pivot point 104. Cam follower 102 is "Y" shaped and includes a first leg 103 and a second leg 105. Second leg 105 has a member 114 which forms an "L" with the rest of second leg 105. Secured to cam follower 102 is low-velocity cable hook 106, which brings about low-velocity printing, in the manner described in the hereinbefore identified typewriter service manuals, when it is pulled by pivoting of cam follower 102. Pivotally secured adjacent cam follower 102 at pivot point 108 is inhibit mechanism 110, also described in such service manuals, which activates cam follower 102 to bring about a low velocity print operation when a small area character is to be printed. Inhibit mechanism 110 includes a projection or shoulder 112 which can catch against member 114 of the second leg 105 of cam follower 102. Springs 117 are interconnected between cam follower 102 and, in particular, second leg 105 and inhibit mechanism 110. Pivotally secured to inhibit mechanism 110 is a rod 116, which is pulled and causes inhibit mechanism 110 to pivot when the keys for the aboveindicated small-area characters are depressed. To accomplish low-velocity printing, rod 116 causes shoulder 112 to disengage from member 114 (FIG. 4), which in turn allows cam follower 102 to follow cam 90 as it revolves through 180°. Cam follower 102 then pulls low-velocity cable hook 106 in response to the rotation of cam 90 to effect a low-velocity printing of the above small-area characters.

Figure 5:
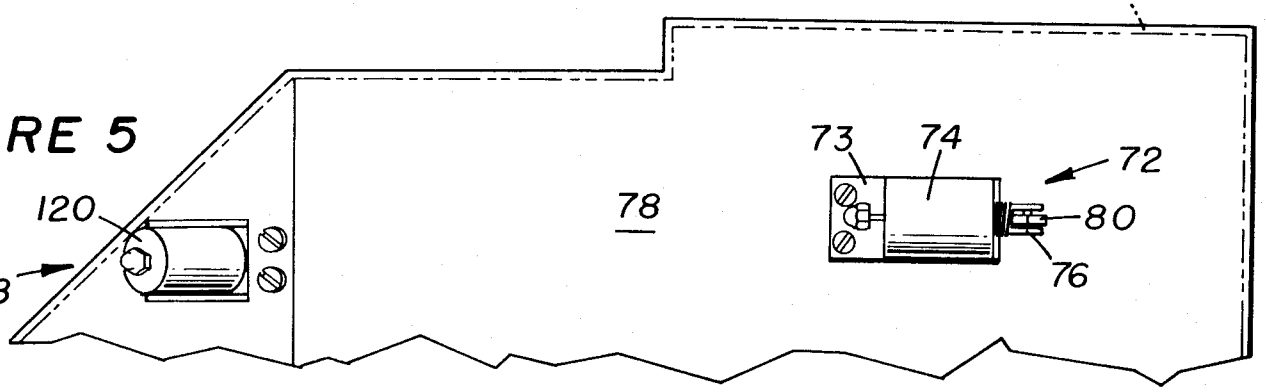
FIG. 5 depicts a bottom view of a portion of the baseplate attachment of the invention.

Another aspect of the invention includes second means 118 secured to the baseplate attachment 12 for actuating the velocity control mechanism 88 of the typewriter 10 (FIG. 1) when a print key 190 is to be used for control signal generation. Second means 118 (FIG. 4) includes a low-velocity solenoid 120, which in a preferred embodiment is a push-type solenoid, and which is mounted by bracket 122 through an aperture 124 in mounting plate 78 (FIGS. 3, 4, 5). Extending from solenoid 120 is an armature or plunger 126 and extending from said armature or plunger 126 (FIGS. 3, 4) is a pushrod 128. When the baseplate attachment 12 is coupled to the typewriter 10 (FIG. 1) as previously described, pushrod 128 (FIG. 3) contacts inhibit mechanism 110 adjacent shoulder 112 of inhibit mechanism 110, with said inhibit mechanism 110 in the first, high-velocity print position as depicted in FIG. 3. For low-velocity printing to occur, the solenoid 120 is actuated through electrical signals whereby pushrod 128 urges inhibit mechanism 110 upwardly (FIG. 4) to position inhibit mechanism 110 in the low-velocity print position, with shoulder 112 disengaged from member 114. Springs 117 cause cam follower 102 to engage and follow cam 90 so that low-velocity printing can be effected.

Figure 6:
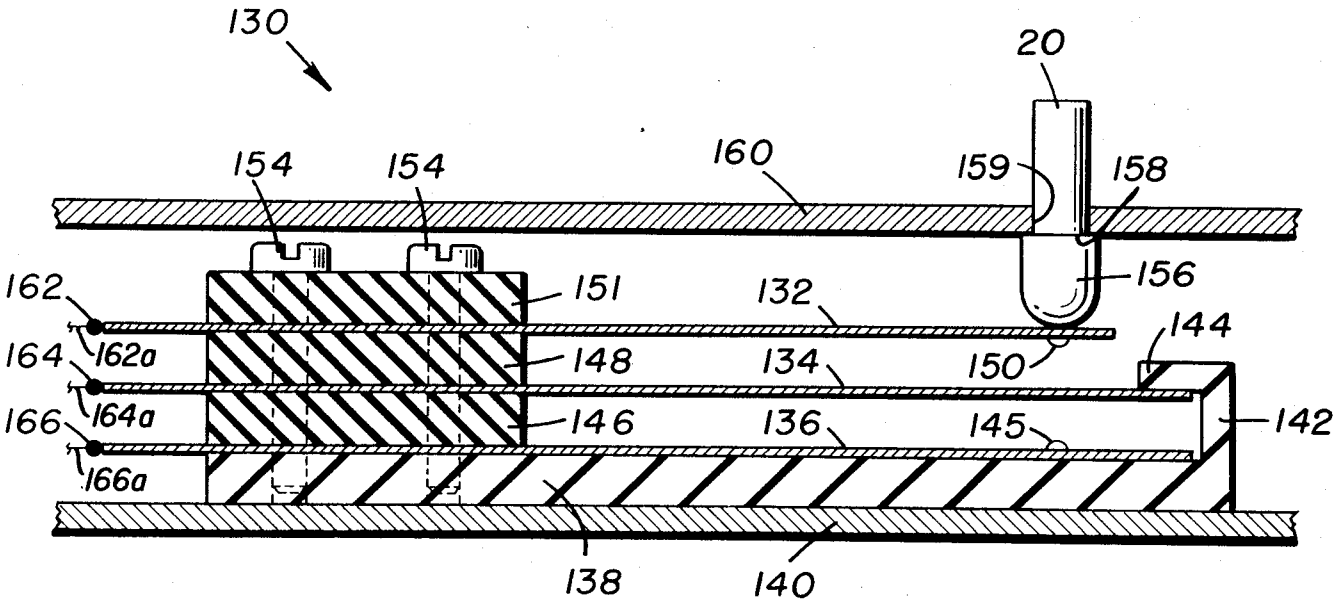
FIG. 6 depicts a control switch of an embodiment of the baseplate attachment of the invention.

When it is desired to use a print key 190 (FIG. 1) to generate a control signal, solenoids 74 and 120 (FIG. 4) are simultaneously actuated by control button 20, which operates a control switch 130 (FIG. 6). Control switch 130 is housed in recall/logic pod 16 and includes first, second and third leaf springs 132, 134 and 136, respectively. Leaf spring 136 rests against an insulator 138 which is mounted on the base 140 of control switch 130. Insulator 138 includes at one end thereof an L-shaped mounting bracket 142, which includes a leg 144 which is parallel to and located above leaf spring 136. Leaf spring 136 further includes a contact point 145. Spaced immediately above and parallel to leaf spring 136 by insulator 146 is leaf spring 134. Leaf spring 134 is by construction biased upwardly, and would come into contact with leaf spring 132 were it not for the upper leg 144 of L-shaped mounting bracket 142 which holds leaf spring 134 in the position which is substantially parallel to leaf spring 136.

Mounted above leaf spring 134 and spaced therefrom by insulator 148 is leaf spring 132, which also by construction is slightly biased upwardly. Leaf spring 132 includes a contact point 150. Another insulator 151 is mounted atop leaf spring 132 and bolts 154 project downwardly through said insulators 151, 148, 146 and 138, and through said leaf springs 132, 134 and 136 to hold the leaf springs 132, 134, and 136 in the above-indicated position (FIG. 6). Control button 20 includes a shoulder 156 which rests against the edge 158 of aperture 159 in upper panel plate 160 of recall/logic pod 16, with an upper portion of control button 20 projecting through said panel plate 160. Shoulder 156 is urged against the edge 158 of aperture 159 by leaf spring 132. Leaf springs 132, 134 and 136 also have contact points 162, 164 and 166 located at the ends of said leaf springs 132, 134 and 136, and connected to appropriate conduits or conductors 162*a*, 164*a* and 166*a* as hereinafter described with respect to FIG. 7. In a preferred embodiment, the leaf spring 134 is the electrical common.

As shown in FIG. 6, control switch 130 is in the open, non-operative position. With the depression of button 20 to place contact point 150 in electrical contact with leaf spring 134, the control switch 130 is in a level-I closure position wherein both the low-velocity solenoid 120 and the lift-off and non-escape solenoid 74 (FIG. 4) are energized simultaneously with the depression of a key of the typewriter 10, as explained below, to effect the generation of a control signal rather than printing of a character. If button 20 is depressed further with additional force which is required to "break through" a tension level maintained by the upwardly-biased leaf spring 134, all three leaf springs 132, 134 and 136 can be brought into electrical contact with contact points 150 and 145 contacting leaf spring 134. In this mode, control switch 130 is in the level-II closure position.

As is more fully described in the above-referenced patents, and in particular in U.S. Pat. No. 3,646,573, the typewriter 10 (FIG. 1) includes a cycle clutch switch 180 (FIG. 7), which operates when a typewriter print key 190 trips the cycle clutch latch link 191. As will hereinafter be described in more detail the present invention coacts with the pre-existing cycle clutch switch 180 of the typewriter 10 (FIG. 1) in that the depression of the print key 190 after the control switch 130 (FIG. 7) of attachment 12 (FIG. 1) has been depressed to the first level (FIG. 7) serves to energize the lift-off and non-escape solenoid 74 and the low-velocity solenoid 120 when switch 180 closes. When tripped, the clutch cycle latch link 191 starts the printing operation of the typewriter 10 (FIG. 1) by engaging the cycle clutch 192. The cycle clutch 192 of this form of typewriter 10 requires ten milliseconds to wind up and start the rotation of the filter shaft 90*a* (FIG. 3) and other parts of the motor-driven print mechanism. During this ten milliseconds of "dead time", the solenoids 74 (FIG. 4) and 120 must completely operate and trip the correcting, lift-off and non-escape mechanism 21 and the low-velocity mechanism 88 of the typewriter 10 (FIG. 1).

By actuating both the lift-off and non-escape solenoid 74 and the low-velocity printing solenoid 120 (FIGS. 3, 4) of the invention simultaneously, it is possible to depress the print keys 190 (FIG. 1) on the typewriter 10 to generate text editing control signals for a word processing circuit 16, 18 or other signal receiving device without the typewriter 10 spacing and without the character of the depressed key imprinting on the paper 31. In fact, the character imprints on the correcting ribbon 29 at low velocity but there is no printing of the character on paper 31 and no embossing of the outline of the character on the paper 31. Electrical connections for actuating the solenoids 74 and 120 for this purpose are depicted in FIG. 7.

Figure 7:
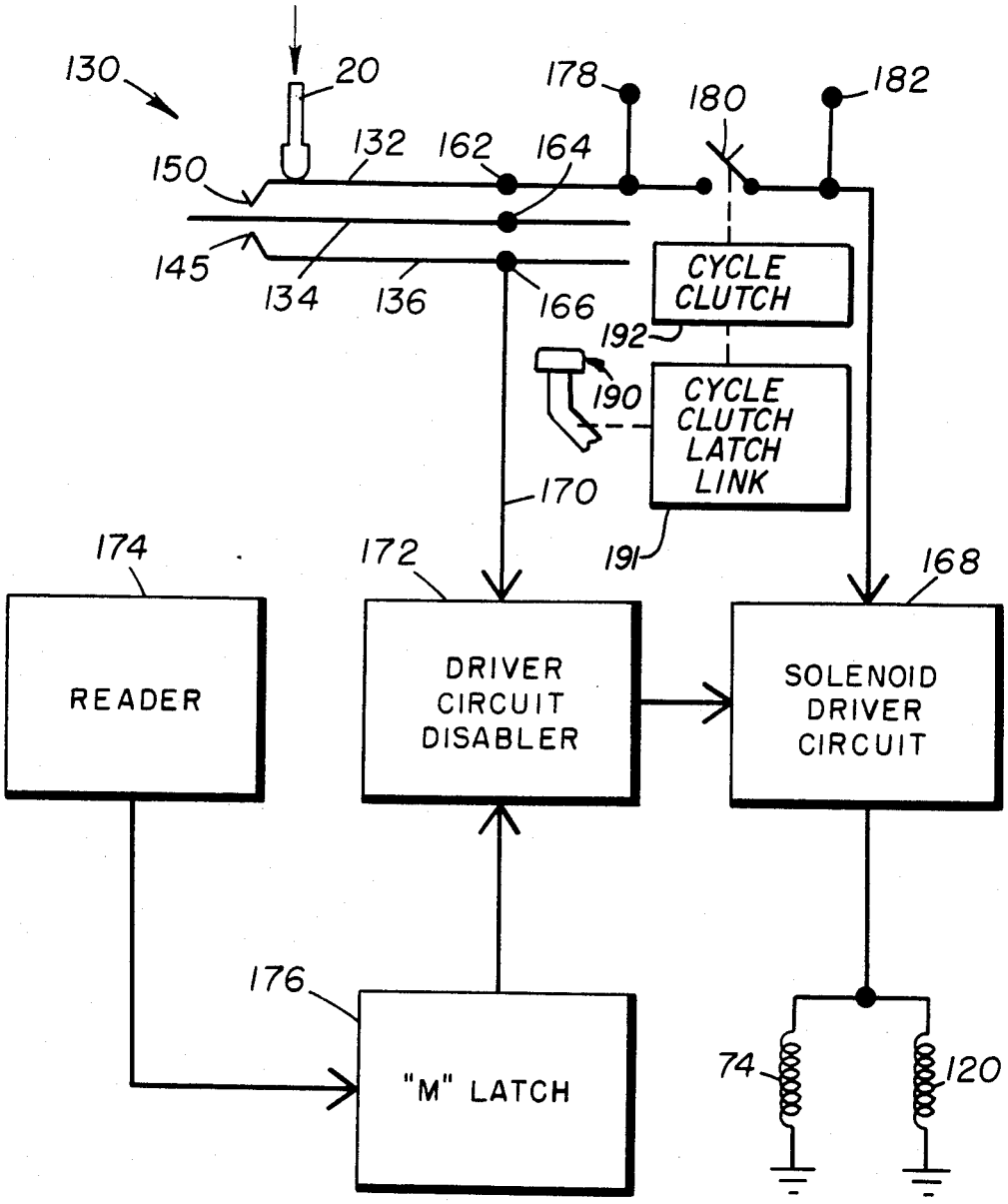
FIG. 7 depicts a schematic diagram for an embodiment of the baseplate attachment of the invention.

FIG. 7 is a schematic diagram of a circuit which includes the control button 20 and the solenoids 74 and 120. Components of baseplate attachment 12 (FIG. 1) which generate and transmit signals identifying operations performed by typewriter 10 may be similar to those of prior U.S. Pat. Nos. 3,452,851 and 3,453,379 and are therefore shown schematically in FIG. 7 as reader 174 except that one such component, cycle clutch sensing switch 180, is depicted separately as it is used to control the timing of energization of the solenoids 74 and 120 of the present invention. In particular, the driver circuit 168 for both solenoids 74 and 120 is connected to the previously described contact point 162 of control signal initiating switch 130 through the cycle clutch sensing switch 180.

As described in the above identified U.S. Patents, typewriters 10 (FIG. 1) of this kind include a cycle clutch latch link 191 (FIG. 7) which is tripped by operation of any of the print keys 190 and then temporarily engages the typewriter cycle clutch 192 to cause printing of the character represented by the key 190. As also described in such patents, cycle clutch sensing switch 180 of baseplate attachment 12 (FIG. 1) temporarily closes at such time. Consequently, in the present invention, solenoids 74 and 120 are temporarily actuated if a print key 190 of the typewriter 10 is operated at a time when the control button 20 (FIG. 1) is depressed to the previously described level I position, although it is possible to arrange for suppression of actuation of the solenoids 74 (FIG. 7) and 120 if certain particular print keys 190 are operated as will hereinafter be described in more detail.

The above described actuation of solenoids 74 and 120 in response to concurrent operation of control button 20 and a typewriter print key 190 in turn actuates the correcting, lift-off and non-escape mechanism 21 (FIG. 3), independently of backspace linkage 36, and also the typewriter velocity control mechanism 88 in the manner previously described. Thus no character is printed on paper 31 (FIG. 1) and no spacing movement of the print element 53 occurs in either direction. A voltage appears at an output terminal 178 connected to control switch contact point 162 to identify the signal produced by by reader 174 as a control signal rather than a print signal.

The level II position of control button 20 may be used for other purposes that may not require suppression of printing and spacing when a typewriter print key 190 is operated. This can be arranged for by connecting a driver circuit disabler 172 between solenoid driver circuit 168 and contact point 166 of control switch 130. It is also possible to provide for selective printing of characters at times when the control button 20 is at the level I position that normally suppresses such typewriter operations. Operation of a particular print key 190, such as the letter "M" key in this example, may be caused to actuate driver circuit disabler 172 by connecting a letter "M" signal detector and storage device 176, herein termed the "M" latch, between reader 174 and driver circuit disabler 172. Thus operation of the letter "M" print key 190, with control button 20 at the level I position, will not result in printing of an "M" but will set latch 176 to disable solenoid driver circuit 168 when a print key 190 is next operated. Thus the next operation of a print key 190 will cause printing of the character represented by such print key 190.

It is to be understood that solenoids 74 and 120 can be directly secured to typewriter 10, if desired, to also perform the above operations. It is accordingly possible to have the above invention "built into" a newly designed typewriter eliminating the spacer band.

The foregoing description of a preferred embodiment of the invention has been presented for purposes of illustration and description. It is not intended to be exhaustive, or to limit the invention to the precise form disclosed, and obviously many modifications and variations are possible in light of the above teachings. The embodiment was chosen and described in order to best explain the priciples of the invention and its practical application to thereby enable others skilled in the art to best utilize the invention in various embodiments and with various modifications that are suited to the particular use contemplated. It is intended that the scope of the invention will be defined by the claims appended thereto.

I claim:

1. In a typewriter attachment having reader means for generating electrical signals that identify characters printed by a typewriter which typewriter is of the form that has a plurality of print keys for initiating printing of characters on a paper, escapement means for initiating a spacing operation following printing of a character, backspacing means for initiating backspacing operations, correction means for removing a previously printed character from said paper, and a manually operable correction initiating key which actuates both said backspacing means and said correction means, and wherein operation of said correction means temporarily inactivates said escapement means, the improvement to said typewriter attachment comprising:

a manually operable control signal initiating switch, means for transmitting a control signal identifying voltage in response to operation of said control signal initiating switch, and actuator means for actuating said correction means of said typewriter independently of said correction initiating key thereof and independently of said backspacing means thereof in response to concurrent operation of said control signal initiating switch of said attachment and a print key of said typewriter, whereby said print keys of said typewriter may be selectively used to initiate non-print control signal generation by said reader means without printing of the characters represented by said print keys on said paper and without spacing operation of said typewriter in either direction.

2. The apparatus of claim 1 wherein said typewriter has a printing element which strikes towards said paper to imprint said characters thereon and has velocity control means for reducing the force of said printing element when small area characters are to be printed, said typewriter attachment further including:

second actuator means for actuating said velocity control means of said typewriter in response to concurrent operation of said control signal initiating switch of said attachment and a print key of said typewriter.

3. The apparatus of claim 1 wherein said typewriter attachment has a cycle clutch sensing switch which closes when said typewriter operates in response to depression of a print key thereof, and wherein said control signal initiating switch is coupled to said first actuator means through said cycle clutch sensing switch to energize and de-energize said first actuator means in response to closing and opening of said cycle clutch sensing switch.

4. The apparatus of claim 1 wherein said typewriter has an internal trigger member which is shifted by operation of said correction initiating key to actuate said correction means and which may also be shifted independently of said correction initiating key to actuate said correction means, and wherein said typewriter attachment includes a baseplate which is securable to the underside of said typewriter, and wherein said first actuator means includes an electrical solenoid and an actuator arm which moves in response to energization of said solenoid, said actuator arm being positioned on said baseplate to extend up into said typewriter to a location adjacent said trigger member thereof at which said movement of said actuator arm shifts said trigger member independently of said correction initiating key of said typewriter.

5. The apparatus of claim 1 wherein said control signal initiating switch includes an electrical common conductor and first and second output conductors and has an open position at which each of said conductors is electrically isolated from the others thereof, a first closed position at which said common conductor and first output conductor are electrically connected and a second closed position at which all of said conductors are electrically connected, said first conductor being coupled to means for transmitting an energizing signal to said first actuator means, further including means for disabling said first actuator means when said control signal initiating switch is at said second position thereof.

6. The apparatus of claim 5 further including means for disabling said first actuator means in response to generation of at least one predetermined specific character print signal by said reader means.

7. The apparatus of claim 1 wherein said control signal initiating switch has first, second and third normally spaced apart conductors, at least said first and second conductors being flexible resilient leaf springs with one thereof being an electrical common and the other therof being coupled to said first actuator means, control button means for deflecting said first conductor into electrical contact with said second conductor and for further deflecting said first and second conductors into electrical contact with said third conductor, said second leaf spring conductor being resiliently biased to deflect towards said first conductor, and a stop element positioned to limit deflection of said second leaf spring conductor towards said first conductor in response to said resilient bias.

8. A typewriter attachment of the form having reader means for sensing operations performed by a typewriter and for producing electrical signals that identify characters printed at the typewriter, the typewriter having print keys for initiating printing of selected characters on a paper, a printing element movable towards said paper to imprint said characters thereon, backspacing means for initiating backspacing operations, correcting, lift-off and non-escape means for removing a previously printed character from said paper, a correction key which jointly actuates said backspacing means and said correcting, lift-off and non-escape means, and velocity control means for reducing the impact force of said printing element when small area characters are being printed, the typewriter attachment comprising:

a baseplate member adapted to be secured to the underside of said typewriter, first and second electrical solenoids secured to said baseplate member, a first actuator arm coupled to said first solenoid and operated thereby, said first actuator arm being positioned to extend up into said typewriter to actuate said correcting, lift-off and non-escape means independently of said correction key and independently of said backspacing means in response to energization of said first solenoid, a second actuator arm coupled to said second solenoid and operated thereby, said second actuator arm being positioned to extend up into said typewriter to actuate said velocity control means in response to energization of said second solenoid, a manually operable control switch for selectively transmitting a control signal identifying voltage, and means for energizing both said first solenoid and said second solenoid in response to concurrent operation of said control switch and a print key of said typewriter.

9. In an electrical switch having first, second and third contacts which are normally spaced apart when the switch is in an unoperated condition, at least the first and second contacts being flexible resilient leaf springs, and having a manually depressible button which is movable to deflect said first contact towards said second contact to establish electrical connection therebetween and which is further movable to deflect both said first contact and said second contact towards said third contact to establish electrical connection between all three of said contacts, the improvement comprising:

said second contact being resiliently biased to deflect towards said first contact, and stop means for limiting deflection of said second contact towards said first contact in response to said resilient biasing of said second contact.

* * * * *